US005460457A

United States Patent [19]

Mindler et al.

[11] Patent Number: 5,460,457

[45] Date of Patent: Oct. 24, 1995

[54] THERMAL PRINTER HAVING TAPERED ROLLERS TO MAINTAIN RECEIVER ALIGNMENT

[75] Inventors: Robert F. Mindler, Churchville; Henry G. Wirth, Rochester, both of N.Y.

[73] Assignee: Eastman Kodak Company, Rochester, N.Y.

[21] Appl. No.: 11,583

[22] Filed: Feb. 1, 1993

[51] Int. Cl.[6] ..... B41J 13/02

[52] U.S. Cl. ..... 400/579; 400/624; 400/641; 271/251

[58] Field of Search ..... 400/579, 624, 400/641; 271/251, 250; 226/184

[56] References Cited

U.S. PATENT DOCUMENTS

| | | | |
|---|---|---|---|
| 3,929,327 | 12/1975 | Olson | 226/184 |
| 4,236,709 | 12/1980 | Hunt | 271/21 |
| 4,257,587 | 3/1981 | Smith | 271/236 |
| 4,426,073 | 1/1984 | Mizuma | 271/251 |
| 4,496,257 | 1/1985 | Habelt et al. | 400/578 |
| 4,546,964 | 10/1985 | Linthout | 271/250 |
| 4,609,320 | 9/1986 | Rubin | 414/225 |
| 4,629,177 | 12/1986 | Roddeman et al. | 271/240 |
| 4,667,863 | 5/1987 | Brunner et al. | 226/184 |
| 4,687,192 | 8/1987 | Hunt | 271/119 |
| 4,728,967 | 3/1988 | Tomita et al. | 226/184 |
| 5,065,998 | 11/1991 | Salomon | 271/251 |
| 5,084,610 | 1/1992 | Markgraf et al. | 235/485 |
| 5,188,468 | 2/1993 | Dykes | 400/579 |
| 5,252,989 | 10/1993 | Kawakami et al. | 400/120.01 |

FOREIGN PATENT DOCUMENTS

| | | | |
|---|---|---|---|
| 0090272 | of 0000 | Japan | 400/579 |
| 1202468 | 8/1989 | Japan | 400/579 |

*Primary Examiner*—Edgar S. Burr
*Assistant Examiner*—John S. Hilten
*Attorney, Agent, or Firm*—Raymond L. Owens

[57] ABSTRACT

A picker mechanism for a thermal printer for urging a dye receiver media sheet into a receiver transport path has a picker wheel with first and second portions and defining a mounting axis. The first portion has an outer traction surface parallel to the mounting axis, and the second portion has a tapered surface for generating a force for urging the dye receiver media sheet from the tapered surface toward the parallel outer traction surface. The picker mechanism compensates for the variability in how an operator loads the dye receiver media and corrects skewing of the media.

16 Claims, 2 Drawing Sheets

THERMAL PRINTER HAVING TAPERED ROLLERS TO MAINTAIN RECEIVER ALIGNMENT

TECHNICAL FIELD OF THE INVENTION

The present invention relates generally to a thermal printer, and more particularly, to a picker mechanism which urges a sheet of dye receiver along a receiver transport path.

BACKGROUND OF THE INVENTION

Thermal printers that use precut sheets of dye receiver media typically provide a stack of many such media sheets in a receiver supply tray. A receiver picker mechanism presses against the top of the receiver supply stack to urge a dye receiver sheet from the stack into the printer. During a printing operation, the receiver picker mechanism drives at least one wheel against the stack of sheets in the receiver supply tray thereby urging a dye receiver sheet along a receiver transport path.

Prior art picker mechanisms typically use a conventional flat wheel shape or a tordoidal wheel shape to drive the dye receiver sheet. The picker wheel is mounted on a picker wheel shaft oriented perpendicular to a feed direction in which the dye receiver is driven. It is possible for the dye receiver sheet to enter the receiver transport path skewed or offset from an orientation which is rectilinear and aligned to the receiver transport path. This can occur when the dye receiver sheet on the receiver supply stack is skewed or misaligned to the feed direction, or when the receiver picker mechanism is angled or misaligned to the feed direction. Tight tolerances and complex assembly procedures may address the receiver picker mechanism orientation problems, but variability in how the user inserts the dye receiver into the printer cannot be controlled easily. Skewed or offset receiver sheet orientations result in printed images which are not rectilinear and centered on the receiver, producing inferior print quality. Accordingly, it will be appreciated that it would be highly desirable to have a picker mechanism which compensates for the variability in how an operator loads the dye receiver media, and which corrects skewing of the media.

SUMMARY OF THE INVENTION

The present invention is directed to overcoming one or more of the problems set forth above. Briefly summarized, according to one aspect of the present invention, an improvement for a thermal printer having a picker mechanism for urging a dye receiver media sheet into a receiver transport path comprises a picker wheel defining a mounting axis and first and second portions. The first portion has an outer traction surface parallel to the mounting axis, and the second portion has a tapered surface for generating a force for urging the dye receiver media sheet from the tapered surface toward the parallel outer traction surface.

The invention provides a receiver picker mechanism with a shaped picker wheel to insure a dye receiver sheet is urged into a receiver transport path properly aligned and oriented for subsequent printing.

According to another aspect of the invention, a picker wheel has first and second sides, and defines an axis of rotation and a centerline axis. The centerline axis is perpendicular to the axis of rotation and located halfway between the first and second sides. A traction surface on the picker wheel is symmetrically positioned about the axis of rotation and has a first portion nonparallel to the axis of rotation so that a low side surface portion of the first portion of the traction surface near the first side is closer to the axis of rotation than a high side surface portion of the first portion of the traction surface near the second side. The high side surface portion is offset from the centerline axis in a direction, and an edge guide perpendicular to the axis of rotation and offset from the centerline axis in the same direction as the high side surface portion.

The picker mechanism compensates for the variability in how an operator loads the dye receiver media and corrects skewing of the media.

These and other aspects, objects, features and advantages of the present invention will be more clearly understood and appreciated from a review of the following detailed description of the preferred embodiments and appended claims, and be reference to the accompanying drawings.

DETAILED DESCRIPTION OF THE PREFERRED EMBODIMENTS

Figure 1:
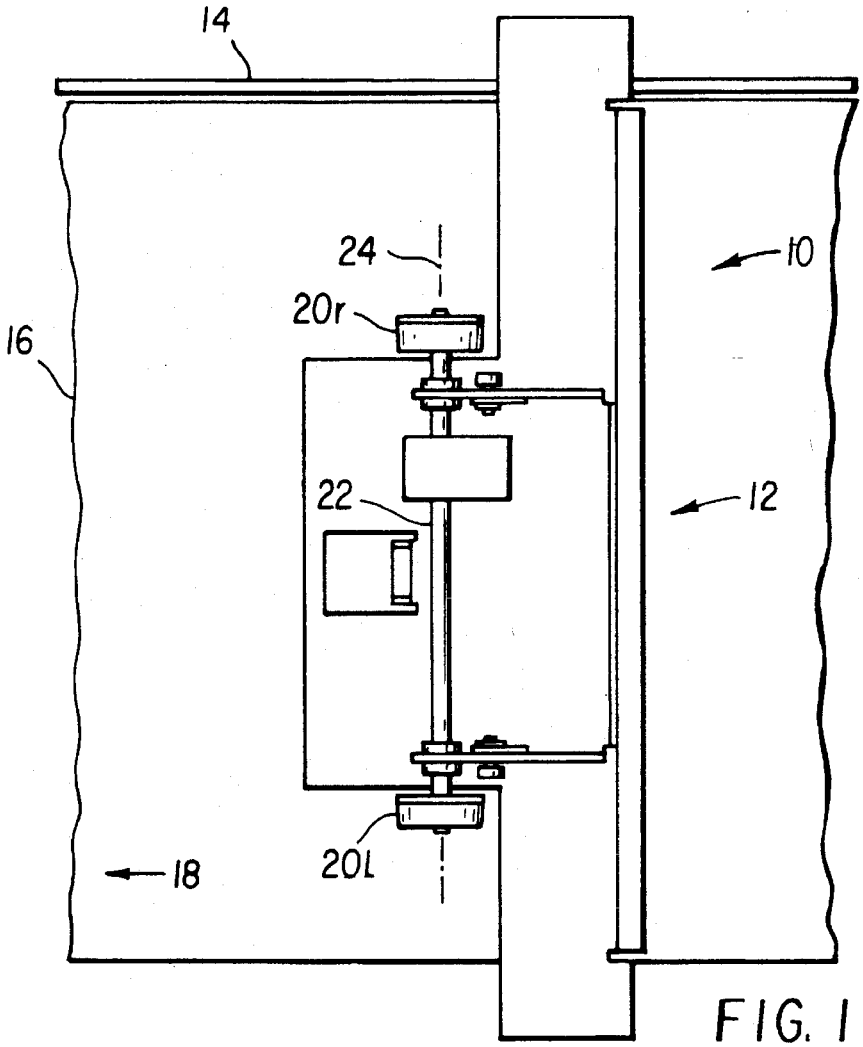
FIG. 1 is a diagrammatic top view of a receiver picker mechanism with a shaped picker wheel to insure a dye receiver sheet is urged into a receiver transport path properly aligned and oriented for subsequent printing.

Referring to FIG. 1, a thermal printer 10 has a dye receiver sheet picker mechanism 12 positioned above a paper tray 14 (only one side of which is shown) containing dye receiver sheets 16 arranged in a stack. The sheets of dye receiver media 16 are fed in the direction of the arrow 18. The dye receiver picker mechanism 12 contains at least one picker wheel 20 defining a mounting axis 24, and preferably two wheels 201 and 20*r*, mounted on a picker wheel shaft 22 about the mounting axis 24 that is oriented perpendicular to the feed direction 18. The dye receiver sheets 16 are fed one at a time from the paper tray 14 by the picker mechanism 12 in the feed direction 18.

Figure 2:
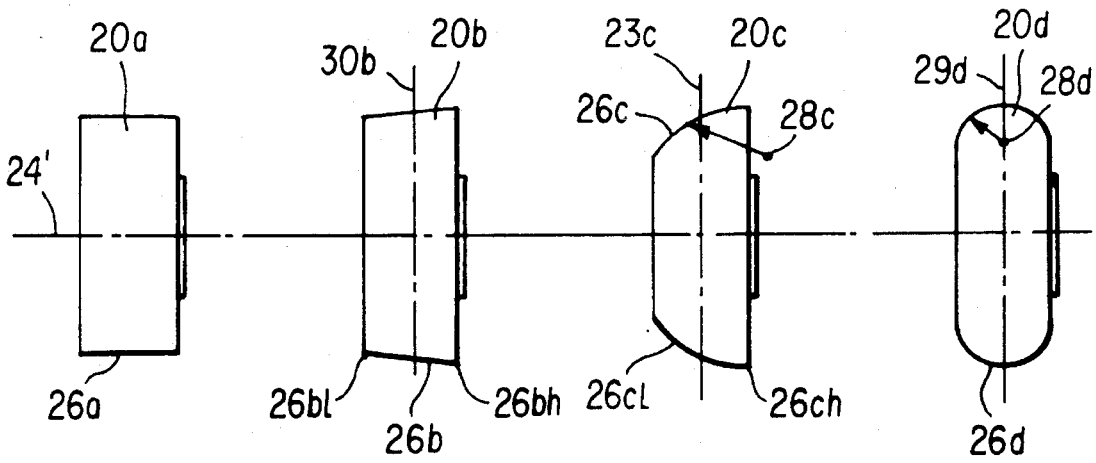
FIG. 2 (PRIOR ART)
FIG. 2 illustrates flat, continuous taper, radiused taper and toriodal picker wheel shapes.

Referring to FIG. 2, the picker wheel 20 may have one of the shapes illustrated. The conventional shape is a picker wheel 20*a* with a single flat traction surface 26*a* that is parallel to the wheel mounting axis 24'. Another typical prior art wheel is a toriodal shaped wheel 20*d* in which the traction surface 26*d* is radiused and the center of curvature 28*d* of the radiused traction surface 26*d* is on the center axis 29*d* defined by the wheel. Both of these picker wheel shapes 20*a*, 20*d* will drive the dye receiver sheet 16 from the stack without changing its orientation and without correcting for any misalignment of the picker mechanism itself.

It has been found that when the traction surface of the picker wheel is generally not parallel to the mounting axis of the wheel, a side force, $F_s$, is generated which drives the dye receiver sheet in a direction from the low side of the traction surface toward the high side of the traction surface. Wheel shapes 20*b* and 20*c* exhibit this characteristic. Picker wheel 20*b* is a continuous tapered picker wheel in which the traction surface 26*b* is a conical shape centered on the mounting axis 30*b* of the wheel 20*b*. Another embodiment is a radiused tapered picker wheel 20*c* where the center of curvature 28*c* of the radiused traction surface 26*c* is not on the center axis 23*c* of the wheel.

Both of these picker wheel shapes generate a side force $F_s$ which urges the dye receiver media in a direction from the low side of the traction surface 26*bl* or 26*cl* toward the high side of traction surface 26*bh* or 26*ch*. Unfortunately, a problem with each of these picker wheel shapes is that the amount of surface contact between the wheel and the dye receiver is small and approaches line contact which would cause deformation in the dye receiver sheets due to a high pressure per unit area that is generated by picker wheel shapes 20*b* or 20*c*. The present invention overcomes the higher pressure, line contact problems by using a combination of the wheel shapes 20*a*–20*d*.

Figure 3:
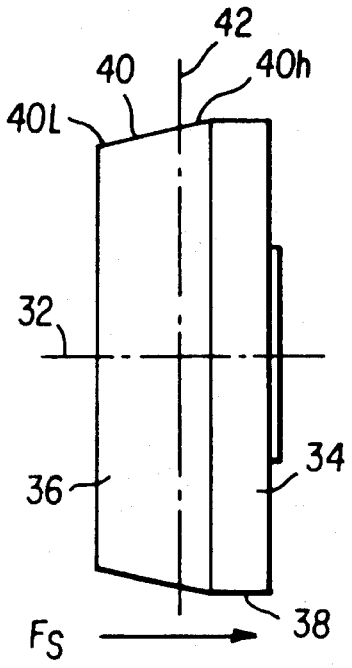
FIG. 3 illustrates a preferred embodiment of a picker wheel according to the present invention having flat and continuous taper sections.

Referring to FIG. 3, a picker wheel 30 has a mounting axis 32 and first and second portions 34, 36. The first portion 34 has an outer traction surface 38 that is parallel to the mounting axis 32 while the second portion 36 has a tapered surface 40 for generating a force for urging the dye receiver media sheet from the tapered surface 40 toward the parallel outer traction surface 38. The direction of the side force, $F_s$, is indicated by the arrow. The side force $F_s$ drives the dye receiver sheet in a direction from the low side 40*l* of the traction surface 40 toward the high side 40*h* of the traction surface 40. The tapered surface 40 may be a continuous tapered surface as illustrated by surface 26*b* (FIG. 2). Preferably, the tapered surface 40 is a conical surface that is centered about the mounting axis 32 so that the second portion 36 is a truncated conical section. The picker wheel 30 also has a centerline axis 42 that is perpendicular to the mounting axis 32 which is also the axis of rotation of the wheel. The centerline axis 42 is located halfway between the first and second portions 34, 36, and the length of the first and second portions along the axis 32 are preferably not equal. The flat surface portion 38 need only be long enough along the axis 32 to eliminate excessive line force pressure.

Figure 4:
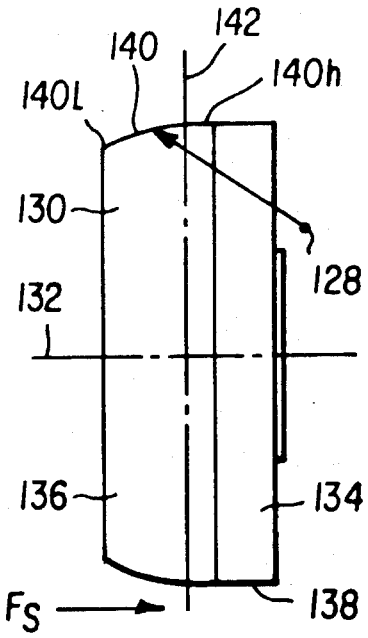
FIG. 4 is a picker wheel similar to FIG. 3, but illustrating another preferred embodiment wherein the picker wheel has flat and radius taper sections.

Referring to FIG. 4, a picker wheel 130 has a mounting axis 132 and first and second portions 134, 136. The first portion 134 has an outer traction surface 138 that is parallel to the mounting axis 132 while the second portion 136 has a tapered surface 140 for generating a force for urging the dye receiver media sheet from the tapered surface 136 toward the parallel outer traction surface 138. The direction of the side force, $F_s$, is indicated by the arrow. The side force $F_s$ drives the dye receiver sheet in a direction from the low side 140*l* of the traction surface 140 toward the high side 140*h* of the traction surface 140. The tapered surface 140 is preferably a radiused taper surface as illustrated by the radiused taper surface 26*c* (FIG. 2). The radiused surface has a center of curvature 128 that is offset from the mounting axis 132.

Figure 5:
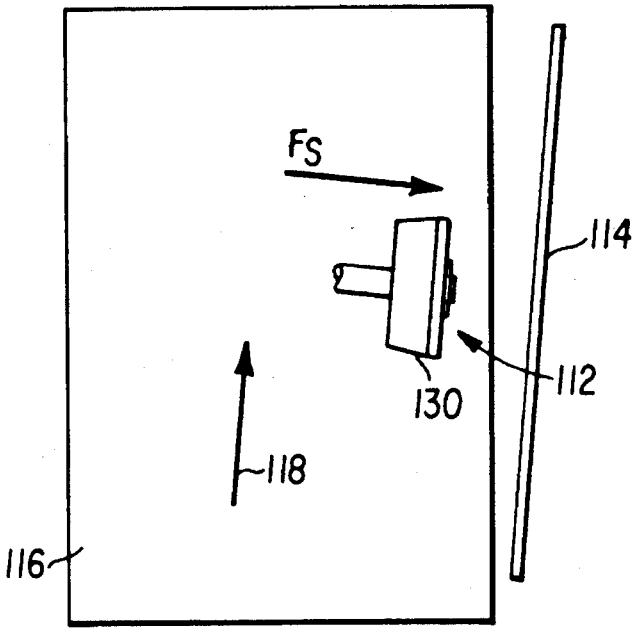
FIG. 5 illustrates a skewed and misaligned sheet being driven and aligned during the picking operation.
Figure 6:
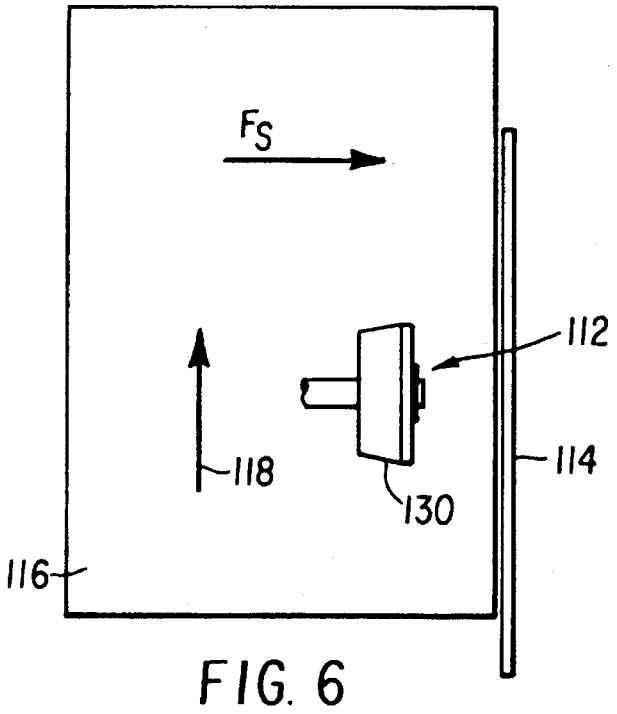
FIG. 6 illustrates the sheet after alignment by the picker wheel.

Operation of the present invention is believed to be apparent from the foregoing description and drawings, but a few words will be added for emphasis with reference to FIGS. 5–6. A perfectly aligned sheet of media is illustrated in FIG. 6 that is guided by the flat traction surface. In FIG. 5, a skewed sheet is subjected to the side alignment force $F_s$ which drives the sheet towards the alignment rail to align it as shown in FIG. 6. The picker wheel 130 is illustrated with the paper tray 114 with the feed direction of the dye receiver 116 shown by direction arrow 118. The side force $F_s$ is also shown by an arrow. As illustrated, the picker mechanism 112 urges the dye receiver in the feed direction 118 that is perpendicular to the side force direction. The side force $F_s$ urges the dye receiver sheet 116 against the edge guide 114. If the dye receiver 116 is skewed or offset from the desired orientation, the side force $F_s$ insures that the dye receiver 116 presses against the edge guide 114 which causes the dye receiver to reorient itself properly. Alternatively, if the receiver picker mechanism 112 is misaligned slightly, the side force $F_s$ would urge the dye receiver sheet against the edge guide even though the feed direction of the picker mechanism is at an angle to the desired direction. The picker wheel shape generates a side force which urges the dye receiver sheet in a direction from the low side of the wheel toward the high side of the wheel. The size of the flat and tapered portions of the picker wheel are selected to optimize the performance of the picker mechanism as side forces desired.

It can be now appreciated that there has been presented a thermal printer which has a picker mechanism to urge a dye receiver sheet into a receiver transport path so that the receiver sheet is oriented rectilinearly and aligned with the transport path. The picker mechanism has at least one picker wheel with first and second sides, an axis of rotation and a centerline axis. The centerline axis is perpendicular to the axis of rotation and is located halfway between the first and second sides. A traction surface on the picker wheel is symmetrically positioned about the axis of rotation. The traction surface has a first portion that is not parallel to the axis of rotation so that a low side surface portion of the first portion of the traction surface near the first side is closer to the axis of rotation than a high side surface portion of the first portion of the traction surface near the second side. The high side surface portion is offset from the centerline axis, and an edge guide is perpendicular to the axis of rotation and is offset from the centerline axis in the same direction as the high side surface portion. As the picker wheel rotates about the axis of rotation, a dye receiver sheet in contact with the picker wheel is driven about an axis orthogonal to the axis of rotation and the centerline axis, and is urged in a direction parallel to the axis of rotation from the low side surface portion to the high side surface portion causing the dye receiver sheet to press against the edge guide thereby properly orienting the dye receiver sheet for printing.

While the invention has been described with particular reference to the preferred embodiments, it will be understood by those skilled in the art that various changes may be made and equivalents may be substituted for elements of the preferred embodiments without departing from invention. For example, any number of wheels may be used, but alignment is easiest with an even number of wheels symmetrically positioned to engage the media sheet. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. In a thermal printer having a picker mechanism for urging a dye receiver media sheet into a receiver transport path, the improvement comprising:

a picker wheel having a mounting axis and first and second sheet-contacting portions, said first portion having an outer traction surface parallel to said mounting axis, said second portion having a tapered surface said first and second portions contacting the dye receiver media sheet for generating a force for urging said dye receiver media sheet from said tapered surface toward said parallel outer traction surface.

2. A thermal printer, as set forth in claim 1, wherein said tapered surface is a conical surface centered about said mounting axis.

3. A thermal printer, as set forth in claim 1, wherein said tapered surface is a radiused surface.

4. A thermal printer, as set forth in claim 3, wherein said radiused surface has a center of curvature offset from said mounting axis.

5. In a thermal printer having a picker mechanism which urges a dye receiver sheet into a receiver transport path, the improvement comprising:

at least one picker wheel having first and second sides, an axis of rotation and a centerline axis, said centerline axis being perpendicular to said axis of rotation and located halfway between said first and second sides;

a sheet-contacting traction surface on said picker wheel symmetrically positioned about said axis of rotation, said traction surface having a first portion non parallel to said axis of rotation so that a small radius side surface portion of said first portion of said traction surface near said first side is closer to said axis of rotation than a large radius side surface portion of said first portion of said traction surface near said second side, said large radius side surface portion being offset from said centerline axis in a direction said sheet contacting traction surface having a second portion, said second portion being parallel to said axis of rotation; and an edge guide perpendicular to said axis of rotation and offset from said centerline axis in the same direction as said large radius side surface portion said first portion being a means to generate a force on the dye receiver sheet to urge the sheet toward said guide.

6. A thermal printer, as set forth in claim 5, wherein said traction surface defines a portion of a surface portion of a cone.

7. A thermal printer, as set forth in claim 5, wherein said traction surface is a curved surface having a center of curvature offset from said centerline axis.

8. A thermal printer, as set forth in claim 5, wherein as said picker wheel rotates about said axis of rotation a dye receiver sheet in contact with said picker wheel is driven about an axis orthogonal to said axis of rotation and said centerline axis and urged in a direction parallel to said axis of rotation from said small radius side surface portion to said large radius side surface portion causing said dye receiver sheet to press against said edge guide thereby properly orienting said dye receiver sheet for printing.

9. A thermal printer, as set forth in claim 5, wherein a portion of said traction surface is conical and an adjacent portion of said traction surface is parallel to said axis of rotation.

10. A thermal printer, as set forth in claim 9, wherein said adjacent portion of said traction surface is located adjacent said large-radius side surface portion.

11. A thermal printer, as set forth in claim 5, wherein a portion of said traction surface is a curved surface with a center of curvature offset from said centerline and an adjacent portion of said traction surface is parallel to said axis of rotation.

12. A thermal printer, as set forth in claim 11, wherein said adjacent portion of said traction surface is located adjacent said large radius side surface portion.

13. A picker mechanism for urging a receiver sheet into a receiver sheet transport path of a printer, said picker mechanism comprising a picker wheel having:

a mounting axis;

a first portion having an outer traction surface parallel to the mounting axis to contact a receiver sheet;

a second portion having a second traction surface concentric with the mounting axis and decreasing in radius away from the first portion for generating a force onto a receiver sheet for urging the receiver sheet in a direction from the second traction surface toward the outer traction surface of the first portion.

14. A picker mechanism as set forth in claim 13 wherein said second traction surface is a conical surface.

15. A picker mechanism as set forth in claim 13 wherein said second traction surface is a radiused surface.

16. A picker mechanism as set forth in claim 15 wherein said radiused second traction surface has a center of curvature offset from the mounting axis.

* * * * *